United States Patent [19]

Hofmann

[11] 4,102,435

[45] Jul. 25, 1978

[54] MECHANICAL SAFETY UNIT ON SPINDLE-DRIVEN LIFTS

[75] Inventor: Dionys Hofmann, Darmstadt-Marienhohe, Germany

[73] Assignee: Gebr. Hofmann KG, Darmstadt, Germany

[21] Appl. No.: 710,158

[22] Filed: Jul. 30, 1976

Related U.S. Application Data

[63] Continuation of Ser. No. 548,810, Feb. 10, 1975, abandoned.

[30] Foreign Application Priority Data

Feb. 22, 1974 [DE] Fed. Rep. of Germany ..... 2408717

[51] Int. Cl.[2] ..... B66F 7/28

[52] U.S. Cl. ..... 187/8.5; 187/24

[58] Field of Search ..... 187/1 R, 8.41, 8.47, 187/8.49, 8.5, 8.59, 8.69, 19, 24, 25; 254/7 R, 7 B, 7 C, 92, 103; 188/82.1, 82.2, 82.3, 82.4, 82.7, 30, 31, 69, 166; 74/577 R, 577 S, 577 M, 530

[56] References Cited

U.S. PATENT DOCUMENTS

| | | | |
|---|---|---|---|
| 1,898,492 | 2/1933 | Morse | 188/30 X |
| 2,001,810 | 5/1935 | Zwald | 188/82.3 |
| 2,750,004 | 6/1956 | Harrison | 187/8.5 |
| 2,873,848 | 2/1959 | Steinmetz | 188/82.4 X |
| 3,141,353 | 7/1964 | Gray | 74/577 |
| 3,309,060 | 3/1967 | Villars | 187/8.41 X |
| 3,687,234 | 8/1972 | Gendreau | 187/8.41 X |
| 3,704,757 | 12/1972 | Buress | 188/69 X |
| 3,958,664 | 5/1976 | Perkins | 187/8.47 |

*Primary Examiner*—Evon C. Blunk
*Assistant Examiner*—James L. Rowland
*Attorney, Agent, or Firm*—Cushman, Darby & Cushman

[57] ABSTRACT

A safety unit for latching against upward movement a spindle driven lift of the type having a lifting nut on which a lifting carriage guided in a column is supported and a safety nut mounted for movement on the spindle for guiding the column in the event of lifting nut failure with a pawl rotatably mounted adjacent the tooth spindle for rotating, urged by a spring, to a locking position preventing rotation of the spindle in one direction when a guide bolt extending through one of a pair of contiguous bores in the pawl having different diameters is shifted axially in response to lifting nut failure, the bolt having different diameter portions along its axis so that the shifting permits rotation of the pawl into its locking position.

11 Claims, 2 Drawing Figures

MECHANICAL SAFETY UNIT ON SPINDLE-DRIVEN LIFTS

Figure 1:
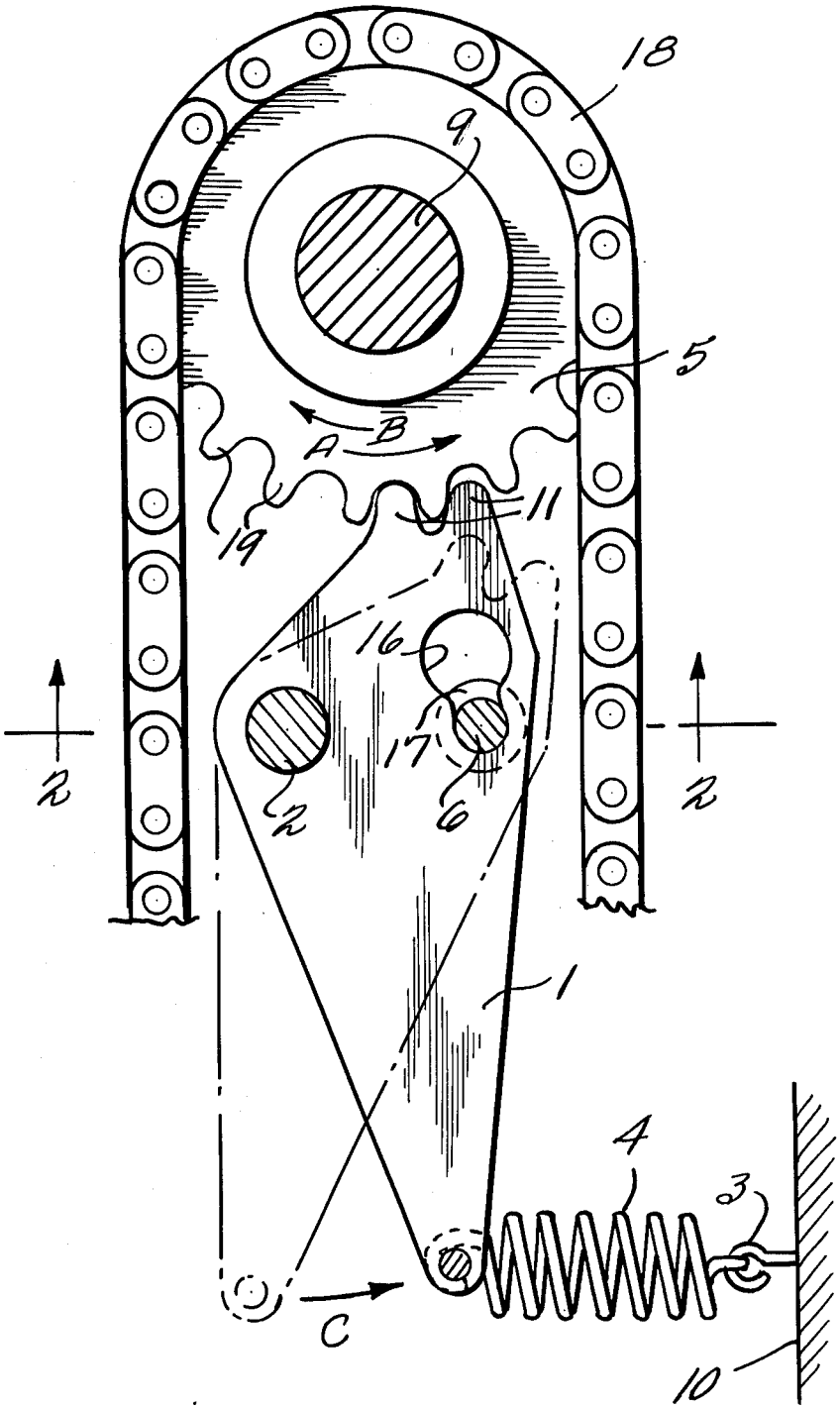

This is a continuation of application Ser. No. 548,810 filed Feb. 10, 1975, now abandoned.

The invention relates to a mechanical safety unit on spindle-driven lifts, especially two-column lifts for motor vehicles, with which a lifting nut on which a lifting carriage guided in a column is supported, is guided on a spindle, and with which a safety nut arranged beneath at a small, constant distance, is during normal operation taken along on the spindle positively actuated.

With spindle-type lifts the lifting nut is a wearing part so that one has to reckon that after a certain working period the thread pitches will be worn-out and there will be no longer any frictional connection between spindle and nut and the load may fall down. It is therefore customary to incorporate, in addition to the lifting nut, a safety nut which during normal operation is taken along without loading and is therefore not subject to wear. This safety nut serves for further carrying the load after the wearing-out of the lifting nut, but is not meant to ensure further operation of the lift. For safety reasons care must therefore be taken that with the aid of the safety nut the load can still be lowered but that further operation is prevented.

There are various solutions and possibilities of preventing further operation. One known possibility is the interlocking through a limit switch which is actuated by the lifting carriage dumping on the safety nut after the wearing-out of the lifting nut, and which interrupts the control circuit for the lifting motor. The disadvantage of this interlocking lies in the fact that it can be bridged so that the lift may be further used without the necessary repair having been effected. Also, mechanical blocking devices are known which are attached to the lifting nut or to the safety nut and, controlled by the distance between these two nuts, still permit the load to be lowered, but during re-lifting knock against a fixed cam on the guide column thus blocking the drive. These pawls attached to the lifting part feature the disadvantage that with their blocking action they have to overcome the enormous lifting force of the drive and must be constructed accordingly.

It is the aim of the invention to avoid the abovementioned disadvantages and to propose a safety unit on lifts with which oversize forces during blocking are avoided, and which cannot be bridged without considerable trouble.

This aim is achieved according to the invention in that a blocking mechanism is provided, which during normal operation takes a mechanically pre-stressed blocking device out of mesh with the spindle itself, and in that, if the lifting carriage falls onto the safety nut, the arresting mechanism is released when the lifting carriage and the safety nut have during lowering reached a bottom position so that the blocking device engages with the spindle under the influence of the mechanical pre-stress.

In an advantageous way the blocking mechanism is arranged at the height of a drive wheel of the spindle which may be designed as a sprocket wheel. The blocking mechanism can then be easily brought into mesh with the drive wheel of the spindle.

In a simple way the blocking mechanism may be designed as a swing plate or pawl swingable round a swing bolt, which can mesh with the teeth of the drive wheel and the meshing part of which is provided with corresponding teeth.

The arresting mechanism may be designed as a guide bolt which during normal operation rests in a borehole of the swing plate and which may be removed from the borehole when the lifting carriage has been lowered onto the safety nut. The guide bolt is removed from the borehole when the lifting carriage and the safety nut have been lowered to a corresponding degree.

In the event of wear or fracture of the carrying nut the lifting carriage falls, of course, on the safety nut. Due to this dumping of the lifting carriage onto the safety nut, the lifting carriage is arranged lower by the distance between carrying nut and safety nut so that in an inferior position after lowering of the lifting carriage and the safety nut the arresting mechanism is released.

The invention is especially advantageous inasmuch as the forces arising during the blocking are much smaller than in the case of known arrangements, with the result that damages to the spindle and the lifting carriage or the lifting nut respectively occur less often than in the case of known devices. In addition, an automatic locking effect of the blocking mechanism is achieved with the invention: The lifting carriage can still be lowered, i.e. the spindle can still carry out one rotary motion in the lowering direction, but it is blocked in the lifting direction.

Figure 2:
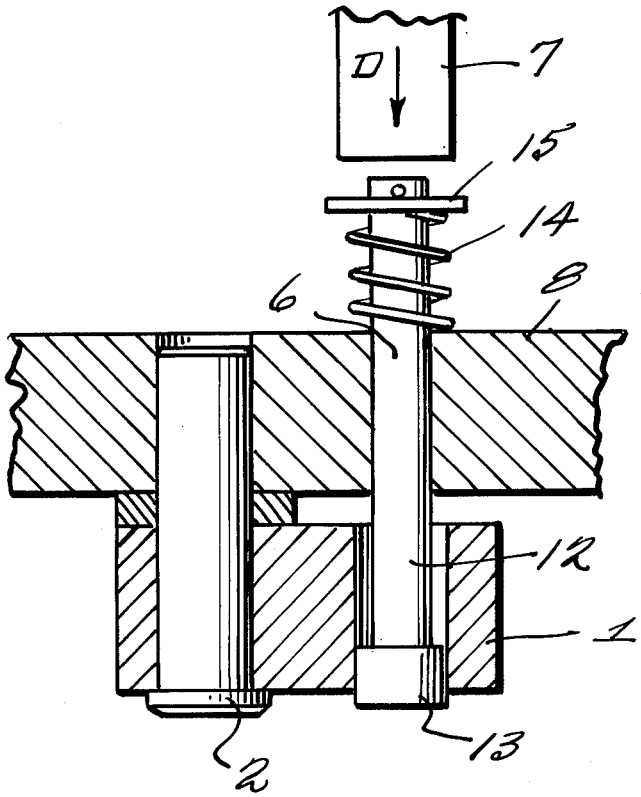

The invention is now explained more in detail on the basis of a preferred embodiment shown in the attached figures, namely:

FIG. 1 Plan view of the safety unit, the actual lift not being shown;

FIG. 2 sectional view along the line 2—2 in FIG. 1.

The blocking mechanism shown in the figures is provided with a pawl 1 swivelling on a swing bolt 2. The swing bolt 2 is rigidly connected to a base plate 8 of the lift (not shown in the figure). The pawl 1 is with one side connected to a mount base 10 of the lift by means of a tension spring 4. The tension spring 4 may be connected to the mount base 10 of the lift by means of a retaining part 3 which may, e.g., be a hook. Under normal conditions, however, the pawl 1 is kept by a guide bolt 6 in a position as shown in dashed lines which permits the sprocket wheel 5 of the lift to rotate freely. Number 7 designates a part of the lifting carriage.

As shown especially from FIG. 1, pawl 1 has a portion provided with teeth 11. With these teeth 11 the pawl 1 can mesh with the teeth 19 of the sprocket wheel 5. The pawl 1 is in addition provided with a borehole composed of a bore part 16 with an enlarged diameter, and a bore part 17 with a reduced diameter. As shown in FIG. 2, the guide bolt 6 also has a portion 12 with reduced diameter and a portion 13 with enlarged diameter. By means of a spring 14 the guide bolt is supported on base plate 8 through support plate 15.

The functioning of the safety unit shown in the figures is as follows. When the carrying nut is destroyed due to wear or fracture, the lifting carriage falls onto the safety nut. Consequently, the lifting carriage part 7 shown in the figure also moves downward in the direction of the arrow D. When the lifting carriage is lowered together with the carrying and safety nuts (not shown), especially when it reaches the extreme bottom position, the guide bolt 6 is pressed downward by the lifting carriage part 7 against the force of the spring 14. This results from the fact that due to the lifting carriage falling from the carrying nut onto the safety nut, the lifting carriage part 7 is also positioned lower. The guide bolt 6 with the guide bolt part 13 featuring an enlarged diameter is then pressed out of the bore part 16 featuring the enlarged diameter so that on account of the initial stress of the spring 4 the swing plate 1 is swung from the dashed-lined position in FIG. 1, i.e. from the normal operation position, into the position marked with lines, in the direction of the arrow C. Thus the teeth of the swing plate 1 mesh with the toothing 19 of the sprocket wheel 5. The sprocket wheel can then no longer rotate in the direction of the arrow B, i.e. the spindle 9 cannot carry out any further rotation in the lifting direction. The drive transmitted to the sprocket wheel 5 by the chain 18 is thus blocked. This blocking also results from the fact that the swing plate 1 can only swing as far as the point where the guide bolt part 12 with the reduced diameter of the guide bolt 6 comes to lie in the bore part 17 with the reduced diameter, touches the stop and remains in that position. Further, the distance between the swing bolt 2 and the teeth 11 on the swing plate 1 is so dimensioned that an automatic locking effect is achieved when the sprocket wheel 5 tends to rotate in the direction of the arrow B. When, however, the sprocket wheel 5 is turned in the direction of the arrow A, i.e. in the lowering direction, the teeth 11 of the swing plate 1 can be released from the toothing 19 of the sprocket wheel 5 so that the lifting carriage can be lowered further. The automatic locking effect of the pawl 1 only appears when a re-start in lifting direction is tried.

The guide bolt, swing bolt and swing plate preferably consist of corrosion-resistant material.

Many changes and modifications in the above described embodiment of the invention can of course be carried out without departing from the scope of the invention. Accordingly, that scope is intended to be limited only by the scope of the appended claims.

What is claimed is:

1. An apparatus for latching against upward movement a spindle driven lift of the type having a lifting nut on which a lifting carriage guided in a column is supported and a safety nut mounted for movement on the spindle for guiding the column in the event of the lifting nut failure comprising a pawl member, means rotatably mounting said pawl member adjacent the spindle so that said pawl member in a locking position prevents rotation of said spindle in the direction which causes upward movement of said lift, and means responsive to failure of said lifting nut for causing said pawl member to shift to said locking position.

2. An apparatus as in claim 1 wherein said pawl mounting means includes a pivot pin pivotably mounting said pawl, and a spring attached between said pawl and a portion of said lift for urging rotation of said pawl about said pivot pin to said locking position.

3. An apparatus as in claim 2 wherein said pawl has first and second contiguous bores of different diameter and wherein said pawl mounting means includes a guide bolt having portions along its axis of first and second diameters corresponding respectively to the diameters of said bores, said guide bolt engaging a portion of said lift so that said guide bolt shifts in a direction parallel to the axis of rotation of said pawl, so that the portion of said bolt engaging said bore changes, permitting said pawl to rotate.

4. An apparatus as in claim 3 wherein said pawl has teeth which, in said locking position engage teeth on a spindle wheel of said lift to prevent rotation in a direction which raises said lift while permitting rotation in a lowering direction.

5. In a mechanical safety device on spindle-driven lifts, with which a lifting nut on which a lifting carriage guided in a column is supported, is guided on a spindle, and with which a safety nut arranged beneath at a small, constant distance is taken along on the spindle positively actuated, the improvement comprising arresting means for, during normal operation, maintaining a prestressed blocking mechanism out of mesh with the spindle, and so that in the event of the lifting carriage falling on the safety nut the blocking mechanism moves into mesh with the spindle once the lifting carriage has been completely lowered so that the blocking mechanism engages with the spindle under the influence of the mechanical pre-stress.

6. In a safety device according to claim, 5 wherein the blocking mechanism is arranged at the height of a drive wheel of the spindle.

7. In a safety device according to claim 5, wherein the blocking mechanism, when engaging with the spindle, permits the spindle to rotate in the lowering direction, but prevents the spindle from rotating in the lifting direction due to mechanical self-locking.

8. In a safety device according to claim 5, wherein the blocking mechanism is provided with a pawl rotatable round a swing bolt, which can mesh with the toothing of a drive wheel and the meshing part of which is provided with at least one tooth.

9. In a safety device according to claim 8, wherein the arresting means includes a guide bolt, which during normal operation rests in a borehole of the pawl and which is removed from the borehole with the lifting carriage lowered onto the safety nut.

10. In a safety device according to claim 9, wherein the guide bolt has a bolt part with enlarged diameter and a bolt part with reduced diameter and is supported on a spring, that the borehole in the pawl has a bore part with enlarged diameter and a bore part with reduced diameter, and that with normal operation the bolt part with the reduced diameter is pushed within the bore part with the larger diameter and that with the lifting carriage lowered onto the safety nut, the part of the guide bolt featuring the larger diameter is, against the force of the spring, pushed so far out of the bore part with the larger diameter that on account of the pawl being pre-stressed, the bore part with the reduced diameter is pushed over the bolt part with the larger diameter.

11. In a safety device according to claim 10, wherein the guide bolt, the swing bolt, and the swing plate consist of corrosion-resistant material.

* * * * *